US005834682A

United States Patent [19]

Warren

[11] Patent Number: 5,834,682

[45] Date of Patent: Nov. 10, 1998

[54] RADAR SIGNAL CARTRIDGE

[76] Inventor: Cyrus E. Warren, 1 Kilgore Dr., Toon, Tenn. 38381

[21] Appl. No.: 382,870

[22] Filed: Feb. 3, 1995

[51] Int. Cl.[6] ..... F42B 5/00

[52] U.S. Cl. ..... 102/439; 102/505; 102/523; 102/449

[58] Field of Search ..... 102/275.3, 357, 102/439, 505, 523, 448, 449

[56] References Cited

U.S. PATENT DOCUMENTS

| | | | |
|---|---|---|---|
| 3,064,575 | 11/1962 | Schumuly | 102/357 |
| 3,720,167 | 3/1973 | Mainhardt et al. | 102/357 |
| 4,333,402 | 6/1982 | Landstrom et al. | 102/505 |
| 4,374,494 | 2/1983 | Maury | 102/505 |
| 4,454,816 | 6/1984 | Billard et al. | 102/505 |
| 4,505,202 | 3/1985 | Fidler et al. | 102/505 |
| 4,516,502 | 5/1985 | Klein et al. | 102/523 |
| 5,147,976 | 9/1992 | Laurensou et al. | 102/275.3 |

FOREIGN PATENT DOCUMENTS

| | | | |
|---|---|---|---|
| 2343990 | 10/1977 | France | 102/505 |
| 731108 | 6/1955 | United Kingdom | 102/275.3 |

*Primary Examiner*—Harold J. Tudor

[57] ABSTRACT

A 12-gauge emergency radar rescue signal cartridge comprises bundles of high density chaff tuned to I-Band frequencies of 8–10 $GH_z$ and packaged in a projectile housed within a 12-gauge 3.0–3.5 inch magnum shot shell. The projectile is deployed to a desired altitude by a propellant charge contained within the base of the shell. The base propellant ignites a pyrotechnic delay train carried by the projectile which allows the projectile to reach apogee geometry before the chaff material is expelled to form a radar reflecting cloud. The cartridge may also be employed to facilitate radar observation of low altitude wind conditions.

10 Claims, 1 Drawing Sheet

RADAR SIGNAL CARTRIDGE

BACKGROUND OF THE INVENTION

This invention relates in general to signaling devices and deals more particularly with an improved radar signal cartridge for deploying high density chaff to form a radar beam reflecting cloud.

Chaff countermeasures were first used in World War II when Allied air crew members threw aluminum rods through ports in aircraft, the length of the rods being in the range of 1½ the wave length of the state-of-the-art great radars of that era (gun fire control systems). These dipole antennas were crude and limited with respect to mass (cross-section), but history shows that these attempts to jam or cause radar aiming systems to move from a tactical target to a "tuned target" (chaff) were generally successful. As radar became more sophisticated, new materials were introduced into this passive countermeasure field employing copious quantities of dipole antenna made from sliced aluminum foil cut to specific lengths and usually arranged for broad-band coverage, because the frequencies associated with enemy fire-control gun systems were generally unknown. However such measures employing thousands of dipoles proved very effective. Such material was used against enemy computerized radar fire control systems for many years and into the post Korean War period. The chaff ejection systems of that era usually employed some form of dispenser which ejected packaged dipoles, the dipole packages being literally torn apart on ejection, strewing the chaff payload over a relatively large area.

Eventually the process of coating glass-filament fibers with molten aluminum was developed. This material ultimately became the most effective passive material for use in any radar confusing scenario and has proven extremely successful for use in tactics such as "breaking track" on missiles homed on a targeted tactical fighter causing the missile to look at the tuned target and miss the aircraft. However, such earlier developments in the field have been almost entirely concerned with interference with enemy radar detection by the creation of spurious images.

A distress signaling device utilizing chaff to produce a radar beam reflecting cloud was proposed at least as early as 1969 as indicated by the patent to Rasmussen, et al. assigned to Pike Corporation of America, Los Angeles, Calif. However, the Rasmussen, et al. signaling system employs a rocket propelled shell, and requires a special purpose rocket launching device particularly adapted for launching the shell.

SUMMARY OF THE INVENTION

In accordance with the present invention a radar signal cartridge comprises a generally cylindrical shotgun casing having a base, a propellant charge disposed within the base and a percussion primer mounted in the base in communication with the propellant charge. A generally cylindrical chaff charge holder disposed within the shell casing forward of the propellant charge has a coaxial cylindrical first bore. A chaff charge which includes a plurality of chaff bundles is disposed within and substantially fills an associated portion of the first bore. A separation charge is also contained within the first bore rearward of the chaff charge. An igniter charge is contained within the chaff charge holder rearward of and in communication with the separating charge for igniting the separating charge. A delay charge is disposed within the chaff charge holder rearward of an in communication with the igniter charge for igniting the igniter charge. The charge holder further contains an ignition charge rearward of and in communication with the delay charge and the propellant charge for igniting the delay charge.

DETAILED DESCRIPTION OF PREFERRED EMBODIMENTS AND METHODS

Figure 1:
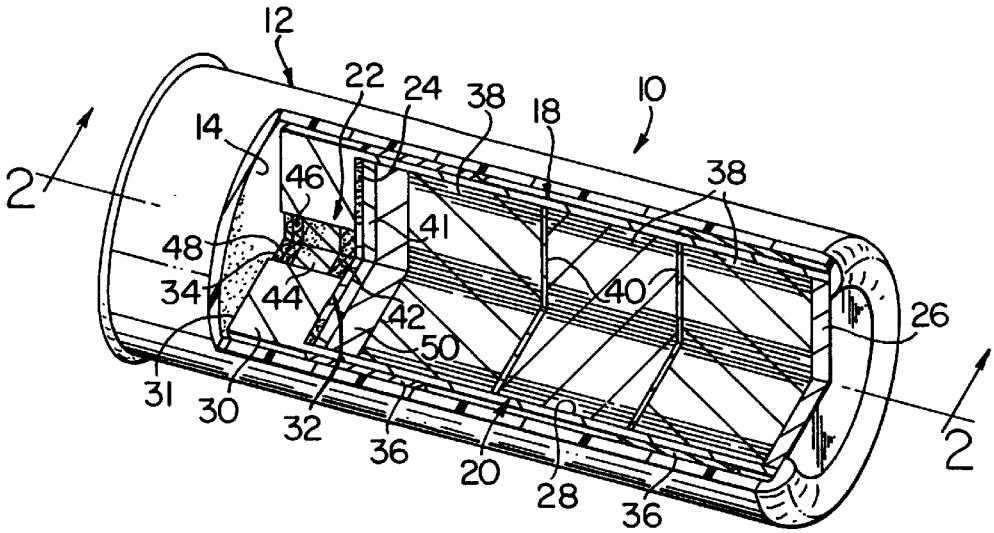
FIG. 1 is a cut-away perspective view of a radar signal cartridge embodying the present invention.

Turning now to the drawing, a high altitude 12-gauge radar signal cartridge or shell embodying the present invention is indicated generally by the reference numeral 10. The illustrated radar signal cartridge 10 is particularly adapted for use with a 12-gauge shotgun and essentially comprises a conventional 12-gauge 3–3.5 inch magnum shotgun shell casing indicated generally by the numeral 12 which carries a propellant or expelling charge 14. The shell casing 12 has a percussion primer 16 mounted in its base portion in communication with the propellant charge. A cylindrical chaff holder, indicated generally at 18, received within the shell casing 12 forward of the propellant charge 14 contains a chaff load indicated generally at 20 and a transfer charge train designated generally by the numeral 22 and and in communication with the propellant charge 14 and with an expulsion or separating charge 24 contained within the charge holder 18 rearward of the chaff load 20. In accordance with the presently preferred construction the forward end portion of the shell casing 12 is rolled or curled radially inwardly into direct engagement with a closure member 26 and sealed forming a closure for both the forward end of the chaff holder 18 and the shell casing 12.

Considering now the radar signal cartridge 10 in further detail, the chaff holder 18 may be made from any suitable material but preferably, it is formed from aluminum and has a coaxial cylindrical side wall, which partially defines forwardly open first bore 28 which contains the chaff load 20. The charge holder 18 also has a rear wall 30 including a radially disposed rearwardly facing rear surface 31 and a radially disposed and forwardly facing front surface 32 which defines the rear surface of the first bore 28. A coaxial generally cylindrical second bore 34 extends through the rear wall 30 and opens through the rear surface 31 and the front surface 32 and into the first bore 28.

Figure 2:
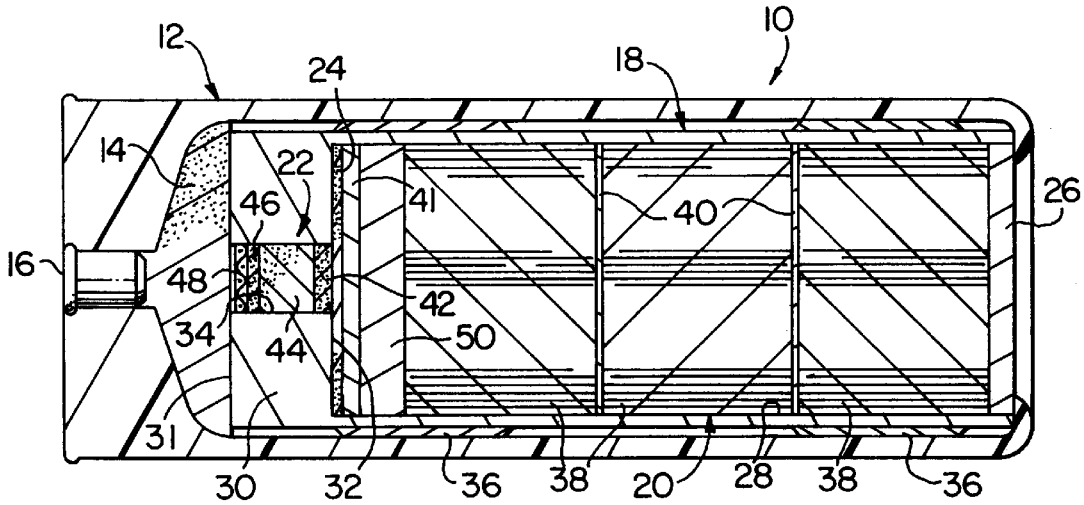
FIG. 2 is a somewhat enlarged axial sectional view taken along the line 2—2 of FIG. 1.

Al least one obturating ring or band coaxially surrounds the chaff holder 18. However, in accordance with the presently preferred cartridge construction two (2) such obturating bands 36,36 are provided and coaxially encircle the chaff holder 18 in axially spaced apart relation to each other, as best shown in FIG. 2. The obturating rings 36, 36 may form an integral part of the chaff holder 18, but preferably and as shown separately formed obturating bands 36,36 are adhered or otherwise secured to the cylindrical chaff holder 18.

The chaff load 20 comprises a plurality of individually generally cylindrical chaff bundles 38,38 (three shown) arranged in coaxially stacked end-to-end relationship to each other within the chaff holder 18 and separated from each other by circular spacers 40,40 as shown in FIG. 2. Each bundle preferably comprises a multiplicity of I-Band dipole antennas (8–10 $GH_z$) formed from aluminum coated glass filaments and packed in closely spaced parallel relation to each other within the chaff holder bore 28.

The tabulation of radar frequency ranges for aircraft, shoreline and ships-at-sea radar installations which follows indicates that reflected signals from dipoles turned to the I-Band will be most favorably received across the broad-band-range and for this reason I-Band chaff dipole antennas have been selected for use in the present radar signal cartridge 10.

| Radar Frequency Ranges | | |
|---|---|---|
| SEARCH AIRCRAFT: | | |
| C-140 | I-BAND | 8–10 $GH_z$ |
| KC-135 | I-BAND | 8–10 $GH_z$ |
| C-141 | KU-BAND | 16 $GH_z$ |
| FIGHTERS | KA-BAND | 32 $GH_z$ |
| COMMERCIAL AIRCRAFT | I-BAND | 8–10 $GH_z$ |
| SHORE LINE RADARS: | | |
| WEATHER | I-BAND | 8–32 $GH_z$ or more |
| MILITARY | I-BAND | 8–32 $GH_z$ or more |
| SHIPS-AT-SEA: | | |
| COMMERCIAL | I-BAND | 8–32 $GH_z$ |
| MILITARY | I-BAND | 8–10 $GH_z$ |
| PLEASURE CRAFT | I-BAND | 8–10 $GH_z$ |

Further considering the construction of the chaff holder 18 and again referring to FIG. 2, a piston is preferably positioned within the charge holder first bore 28 rearward of the chaff load 20. The piston, indicated at 41, is preferably formed from a generally cylindrical disc of suitable material having a diameter substantially equal to the diameter of the first bore 28. The separation charge 24 is located within the first bore 28 rearward of the chaff charge or more specifically between and adjacent the piston 41 and the bore rear surface 32.

In accordance with the presently preferred construction a generally cylindrical inertia weight 50 is contained within the first bore 28 and positioned between the piston 41 and the rear surface of the chaff charge 20 and preferably comprises a disc formed from litharge or lead oxide.

The transfer charge train 22 is contained within the second bore 34 and includes a transfer charge 42 in communication with the separating charge 24 for igniting the separating charge. The charge train 22 further includes a delay charge 44 disposed rearward of and in communication with the transfer charge 42 for igniting the latter charge and an ignition charge 46 located rearward of the delay charge 44 and in communication with the delay charge 44 and the propellant charge 14 for igniting the delay charge 44.

Preferably and as shown a baffle 48 is provided which is formed by a wire screen is located between the propellant charge 14 and the ignition charge 46. In accordance with the presently preferred construction the wire screen 48 is contained with the second bore 34.

The various charge compositions which comprise the charges used in the cartridge 10 are hereinafter listed together with alternate compositions also suitable for use in making a radar signal cartridge in accordance with the present invention.

| Charge Composition |
|---|
| PROPELLANT CHARGE: |
| Double Base Propellant |
| Mix Option: Boron, Potassium Nitrate for ignition/altitude |
| DELAY CHARGE IGNITION: |
| GASLESS A1A/Boron Potassium Nitrate |
| DELAY CHARGE OPTIONS: |
| 1. Zirconium, Nickel, Barium Chromate, Potassium Perchlorate |
| 2. Manganese, Barium Chromate, Lead Chromate |
| 3. Tungsten, Barium Chromate, Potassium Perchlorate |
| 4. Born, Barium/Calcium Chromate |
| TRANSFER CHARGE: |
| Gasless, A1A/Boron Potassium Nitrate |
| EXPULSION CHARGE: |
| Black Powder/Double Base Propellant |
| Mix Option: Boron, Potassium Nitrate |

The closure member 26 is disposed within the forward end of the first bore 28 adjacent the radially disposed frontal surface chaff charge and provides a closure for both the chaff charge holder 18 and the shell or cartridge casing 12, as previously noted. A quantity of a suitable sealing material located between the inwardly rolled edge of the shell casing the closure member 26 provides a weatherproof seal for the cartridge 10.

Figure 3:
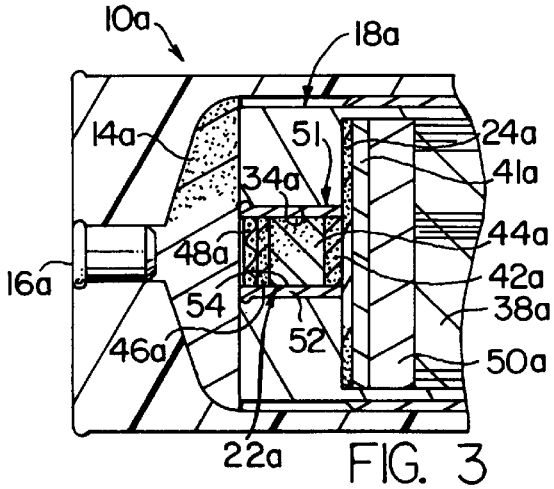
FIG. 3 is a fragmentary axial sectional view similar to FIG. 2 but shows another embodiment of the invention.

Referring now to FIG. 3 another radar signal cartridge embodying the present invention is indicated generally by the reference numeral 10*a*. The cartridge 10*a* is similar in most respects to the previously described cartridge 10, and parts corresponding to parts of the previously described cartridge bear the same reference numeral and a letter "a" suffix and will not be hereinafter described in detail.

The cartridge 10*a* differs from the cartridge 10 in that the transfer charge train comprises a unitary insert indicated generally at 51 which is loaded, as a unit into the chaff holder 18*a*. The insert 51 includes a cylindrical housing 52 which has a cylindrical bore 54 extending coaxially through it. A transfer charge 42*a*, a delay charge 44*a* and an ignition charge 46*a* are loaded in the bore 52 substantially as previously described with reference to the delay charge train 22*a*. A wire screen baffle 48*a* is also contained with the bore 52*a* and is located rearward of the ignition charge 46, substantially as shown. The chaff holder bore 34*a* is sized to receive the insert 51 in press fit therein.

The radar signal cartridge 10 is loaded into a conventional unmodified 12-gauge shotgun which is elevated to loft the chaff package to a desired altitude and fired in a conventional manner. The percussion primer 16 ignites the propellant charge 14 to loft the chaff holder 18 to a desired altitude ranging from 18 to 1000 feet. The propellant charge 14 ignites the transfer charge train 22 or more specifically the ignition charge 46 through the screen wire baffle 48, which protects the transfer charge train from damage. The igniter charge, in turn, ignites the delay charge 44 which has a predetermined burn time which may, for example, range from 2.5 to 3.5 seconds. This delay time allows the chaff holder to attain apogee before the transfer charge 42 ignites the separation charge 24. Gases of explosion generated by the ignition of the separation charge 24 act between the rearwardly facing surface of the piston 40 and the forwardly facing rear surface 32 to expel the chaff bundles from the chaff holder.

A typical 12-gauge magnum projectile may contain a chaff payload having a theoretical cross section of 240 square meters. The dispersed chaff becomes immediately obvious on a radar screen as a hard target which grows to a very large size and generally stays within the original area of disbursement moving via lofted winds. The sudden observance of the target echo on a radar screen (P.P.I.) should prove sufficient to prompt immediate inquiry. A typical search radar (weather) would spot such a target from a great distance thereby possibly allowing search aircraft or ships at sea to immediately home-in on the area of emergency.

Although the present radar signal cartridge is ideally suited for signaling an emergency at sea, it will be apparent that the cartridge may also be employed as a land rescue signaling device when an emergency situation is encountered in a mountainous or desert region.

The present cartridge may also be employed to monitor wind shear or clear-air-turbulence (CAT) in a landing pattern for approaching aircraft. Radar signal cartridges lofted the altitude "window" of concern allow the control tower/radar operators to detect potentially hazardous conditions in time to alert approaching aircraft, so that an alternate landing plan may be selected, where appropriate.

I claim:

1. A radar signal cartridge comprising in combination a generally cylindrical shotgun shell casing having a base, a propellant charge disposed within said base, a percussion primer mounted in said base and communicating with said propellant charge, a generally cylindrical chaff charge holder coaxially disposed within said shell casing forward of said propellant charge and having a rear wall including a radially disposed front surface, a radially disposed rear surface in face-to-face engagement with said propellant charge, and a forwardly opening coaxial cylindrical first bore having a radially disposed rear end defined by said front surface of said rear wall, said chaff charge holder having a second bore defined by and extending coaxially through said rear wall and opening through said front surface and said rear surface, a chaff charge including a plurality of generally cylindrical chaff bundles coaxially disposed in end-to-end relation to each other within and substantially filling an associated portion of said first bore, a generally cylindrical inertia weight disposed within said first bore rearward of and in engagement with said chaff charge, a generally cylindrical piston having a diameter substantially equal to the diameter of said first bore and coaxially disposed within said first bore rearward of and in engagement with said inertia weight, a separating charge disposed within said first bore between and in engagement with said piston, and said front surface, a delay charge train contained within said second bore and including an igniter charge communicating with said separating charge, a delay charge disposed rearwardly of and communicating with said igniter charge, an ignition charge disposed rearwardly of and communicating with said delay charge, and a wire screen baffle disposed rearwardly of said ignition charge, said ignition charge communicating with said propellant charge through said baffle, and a closure member disposed within the forward end of said first bore in engagement with said chaff charge and forming a closure for both said chaff holder and said shotgun shell casing.

2. A radar signal cartridge as set forth in claim 1 wherein said chaff charge comprises three chaff bundles.

3. A radar signal cartridge as set forth in claim 2 wherein each of said chaff bundles comprises a multiplicity of I-Band dipoles.

4. A radar signal cartridge as set forth in claim 3 wherein said dipoles are tuned to 8–10 $GH_2$.

5. A radar signal cartridge as set forth in claim 3 wherein said dipole antennas comprise aluminum coated glass filaments packed in closely spaced parallel relation to each other within said chaff bundles.

6. A radar signal cartridge as set forth in claim 1 wherein said chaff charge holder comprises a charge holder body and at least one obturating band attached to an outer surface of and coaxially surrounding said charge holder body and engaged with an inner surface of said shotgun shell casing.

7. A radar signal cartridge as set forth in claim 6 wherein said chaff charge holder includes a plurality of axially spaced apart obturating bands.

8. A radar signal cartridge as set forth in claim 1 wherein said signal cartridge includes an insert mounted in said second bore and containing said delay charge, said igniter charge and said wire screen baffle.

9. A radar signal cartridge as set forth in claim 1 wherein said cartridge includes an insert mounted within said rear wall and said delay charge train is contained within said insert.

10. A radar signal cartridge comprising in combination a generally cylindrical shotgun shell casing having a base, a propellant charge disposed within said base, a percussion primer mounted in said base and communicating with said propellant charge, a generally cylindrical chaff charge holder coaxially disposed within said shell casing forward of said propellant charge and having a rear wall including a radially disposed front surface, a radially disposed rear surface in face-to-face engagement with said propellant charge, and a forwardly opening coaxial cylindrical first bore having a radially disposed rear end defined by said front surface of said rear wall, said chaff charge holder having a second generally cylindrical bore defined by and extending coaxially through said rear wall and opening through said front surface and said rear surface, a plurality of axially spaced apart annular obturating bands coaxially surrounding said chaff charge holder and engaging an inner surface of said shotgun shell casing, a chaff charge including three generally cylindrical chaff bundles coaxially disposed in end-to-end relation to each other within and substantially filling an associated portion of said first bore, each of said chaff bundles including a multiplicity of aluminum coated glass dipole antennas tuned to 8–10 $GH_2$ and disposed in closely spaced parallel relation to each other, a generally cylindrical inertia weight having a diameter substantially equal to the diameter of said first bore and disposed within said first bore rearward of and in engagement with said chaff charge, a generally cylindrical piston having a diameter substantially equal to the diameter of said first bore and coaxially disposed within said first bore rearward of and in engagement with said inertia weight, a separating charge having a diameter substantially equal to the diameter of said first bore and disposed within said first bore between and in engagement with said piston and said front surface, a delay charge train contained within said second bore and including an igniter charge communicating with said separating charge, a delay charge disposed rearwardly of and communicating with said igniter charge, an ignition charge disposed rearwardly of and communicating with said delay charge, and a baffle disposed rearwardly of said ignition charge, said ignition charge communicating with said propellant charge through said baffle, and a closure member disposed within the forward end of said first bore in engagement with said chaff charge and forming a closure for both said chaff holder and said shotgun shell casing.

* * * * *